United States Patent [19]

Takahashi

[11] Patent Number: 4,746,466

[45] Date of Patent: May 24, 1988

[54] ULTRASONIC ATOMIZING APPARATUS

[75] Inventor: Minoru Takahashi, Tokyo, Japan

[73] Assignee: TDK Corporation, Tokyo, Japan

[21] Appl. No.: 932,819

[22] Filed: Nov. 20, 1986

[30] Foreign Application Priority Data

Mar. 3, 1986 [JP] Japan ..... 61-29243[U]
Jun. 18, 1986 [JP] Japan ..... 61-93116[U]
Jun. 18, 1986 [JP] Japan ..... 61-93117[U]

[51] Int. Cl.[4] ..... B01F 3/04

[52] U.S. Cl. ..... 261/30; 261/81; 261/DIG. 48

[58] Field of Search ..... 261/DIG. 48, 81, 30

[56] References Cited

U.S. PATENT DOCUMENTS

| | | | |
|---|---|---|---|
| 3,469,785 | 9/1969 | Boucher et al. | 261/DIG. 48 |
| 3,901,443 | 8/1975 | Mitsui et al. | 261/DIG. 48 |
| 3,989,042 | 11/1976 | Mitsui et al. | 261/DIG. 48 |
| 4,031,171 | 6/1977 | Asao et al. | 261/DIG. 48 |
| 4,563,313 | 1/1986 | Tsuaki | 261/DIG. 48 |
| 4,640,804 | 2/1987 | Mizoguchi | 261/DIG. 48 |

FOREIGN PATENT DOCUMENTS

| | | | |
|---|---|---|---|
| 52-28155 | 2/1977 | Japan | 261/DIG. 48 |
| 54-56236 | 7/1979 | Japan | 261/DIG. 48 |
| 59132777 | 2/1980 | Japan . | |
| 60-117039 | 6/1985 | Japan | 261/DIG. 48 |
| 53113269 | 3/1986 | Japan . | |

*Primary Examiner*—Tim Miles
*Attorney, Agent, or Firm*—Armstrong, Nikaido, Marmelstein & Kubovcik

[57] ABSTRACT

The present invention is an ultrasonic atomizing apparatus which atomizes water supplied into an atomizing chamber from a water tank disposed on top of a case, by means of ultrasonic waves. The apparatus blows out the mist produced by atomizing the water in the atomizing chamber. The interior of the case is partitioned into two sections by a vertical partition wall. The atomizing chamber is formed in one of the sections. An atomizing unit is attached to the bottom wall of the atomizing chamber. An electric fan and a power transformer are disposed vertically in the other section of the case.

11 Claims, 9 Drawing Sheets

ULTRASONIC ATOMIZING APPARATUS

BACKGROUND OF THE INVENTION

1. Field of the Invention

The present invention relates to an ultrasonic atomizing apparatus used for a moistening device or the like which atomizes liquids such as water by ultrasonic vibrations to moisten it.

2. Description of the Prior Art

FIG. 9 is a schematic view showing a conventional construction of a home moistening device, which has a box-like body 80 interiorly provided with an atomizing tank 81. The atomizing tank 81 has an ultrasonic vibrator 82 mounted on a bottom plate thereof. The body 80 is provided on the bottom portion with a power transformer 83, an electric fan 84 for blowing air to the atomizing tank 81 and a driving circuit 85 for the vibrator 82. The body 80 is provided on the upper portion with a water tank 87 storing water 86 therein. A discharge pipe 88 is provided adjacent the water tank 87. The water tank 87 is provided on the bottom plate with an automatic water valve 89. The body 80 is provided on the lower portion with an air intake opening 91, through which air taken in from the fan 84 passes a portion of the driving circuit 85 as indicated by the arrow to cool a vibrator driving power transistor. The air is then introduced into the atomizing chamber 81 so as to carry a mist through the discharge pipe 88 from a water column 90 generated by action of the vibrator. A preferable depth of water 86 within the atomizing chamber 81 is decided according to the vibratory frequency of the vibrator 82 and the vibrator power of a radiation area (generally, in the range of 1.8 MHz to 2.4 MHz). The ultrasonic vibrator 82 and the driving circuit 85 constitute an ultrasonic atomizing unit 110.

Recently, the conventional ultrasonic atomizing apparatus which is used as a home moistening device, is very popular due to its fine mists generated therefrom. However, most of these apparatuses are manufactured with an assuption that the apparatus is set in a room of 3.3 m×4 m or 13.2 $m^2$. The apparatus has a discharge of approximately 400 cc/H to meet the room size. The apparatus is designed so that when it is operated at the maximum rate with the water tank 87 fully filled with water, the apparatus will continue to operate for eight hours. Therefore, the capacity of the water tank 87 required is from 4 l to 5 l. Further, since the water tank 87 is installed on the atomizing chamber 81, a large cavity 92 is formed between the power transformer 83, the fan 84 and the water tank 87, thus forming the apparatus into a relatively large size as a whole. If a room is partitioned into small rooms of 3.3 m×3 m (9.9 $m^2$)m to 2.25 m×3.3 m(7.425 $m^2$) or a heater is provided in the room, one moistening device is necessary for each room. However, in prior art apparatus, the space occupied by the apparatus is large, the moistening capacity of the apparatus is excessively large for a narrow room, and a cost thereof is high. This makes it impossible to use a moistening device for each room, which poses a problem because one unit of a moistening device is forced to be placed in a relatively large room such as a living room.

Next, the construction and problems of the ultrasonic atomizing unit 110 used for the aforesaid apparatus will be discussed in connection with FIGS. 10 and 11.

FIG. 10 shows one example of an ultrasonic moistening device which uses a conventional ultrasonic atomizing unit, and FIG. 11 is a plan view of an ultrasonic atomizing unit portion thereof. In FIGS. 10 and 11, reference numeral 101 designates a metal base having a large wall-thickness such as aluminum die casting. An ultrasonic piezo-electric vibrator 103 in the form of a disc-like piezo-electric ceramic is mounted on the metal base 101 through a resilient support 102. Here, the vibrating surface of the piezo-electric vibrator 103 is arranged to be inclined with respect to the metal base 101 (i.e., inclined with respect to the surface of water to be atomized). A print substrate 104 is connected by means of screws to one end of the metal base 101, and a driving circuit 105 is assembled on the print substrate. The thus constructed ultrasonic atomizing unit 110 is watertightly secured to a mounting hole 113 in the bottom of a water tank 112 storing water 111.

It is noted that the vibrating surface of the piezo-electric vibrator 103 is inclined with respect to the water surface in order to enhance the atomizing efficiency. That is, atomization is effected in the vicinity of the forward end of a water column 114 caused by ultrasonic waves but if the vibrating surface of the vibrator 103 is not inclined, the water column 114 rises vertically, in which case large water droplets, which are not atomized, fall on the water column to deteriorate the atomizing efficiency. To prevent this, the vibrating surface is inclined to incline the water column to prevent the unatomized large water droplets from directly falling on the water column, thus enhancing the atomizing efficiency.

In the aforementioned atomizing unit, the driving circuit is arranged below or laterally of the piezo-electric vibrator. In either case, both the elements are connected by a lead wire. This increases an occupying area of the unit. As a consequence, a problem arises in that the incorporated apparatus becomes large.

Furthermore, when the vibrating surface of the vibrator 103 is inclined, the inclining direction of the water column 114 is defined according to the type of an ultrasonic moistening device, for example, according to the construction of an atomizing chamber or the like. However, in the conventional construction as shown in FIGS. 10 and 11, since the print substrate 104 or the like is mounted geometrically asymmetrically with respect to the center of the vibrator 103, it is difficult to mount the ultrasonic atomizing unit 110 rotated on the body portion of the ultrasonic moistening device in order to take precedence of the inclining direction of the vibrating surface of the vibrator 103. Therefore, in the past, four kinds of ultrasonic atomizing units are assembled having a piezo-electric vibrator inclining in at least four directions, as indicated by arrows A, B, C and D. Therefore, in assembling, four ways of assembling have to be carried out always in consideration of the inclinding direction of the piezo-electric vibrator, which poses further problems in that the assembling work is cumbersome and the volume production is impaired.

The present invention has been achieved in view of the foregoing, and it is an object of the invention to provide an ultasonic atomizing apparatus which can be miniaturized and which can be produced in volume.

SUMMARY OF THE INVENTION

For achieving the aforesaid object, a first invention provides a small and inexpensive ultrasonic atomizing apparatus which can be placed in a relatively narrow room. In a space within the apparatus body adjacent to an atomizing tank, a power source portion for supplying power to an atomizing unit and an electric fan for blowing air to the atomizing tank are longitudinally arranged.

For achieving the aforesaid object, a second invention provides a small and inexpensive ultrasonic atomizing apparatus which can be placed in a relatively narrow room. A part of a bottom portion of a water tank is projected downwardly. The projection is formed so as to occupy an area other than areas occupied by a discharge pipe for mists within an atomizing tank to outside. A heat loss preventive water-level detector is provided within the atomizing tank. The projection has an automatic water valve mounted on the bottom thereof.

For achieving the aforesaid object, a third invention provides an ultrasonic atomizing unit in which a piezo-electric vibrator is provided on a metal base. A mounting hole is formed in the metal base point-symmetrically with respect to a center of the piezo-electric vibrator. A lead of an electrode in contact with the piezo-electric vibrator is directly connected to a conductive pattern of a print substrate incorporating a driving circuit which drives the piezo-electric vibrator.

BRIEF DESCRIPTION OF THE DRAWINGS

FIG. 8(*b*) shows a driving circuit including noise reducing measures;

DESCRIPTION OF THE PREFERRED EMBODIMENTS

Figure 1:
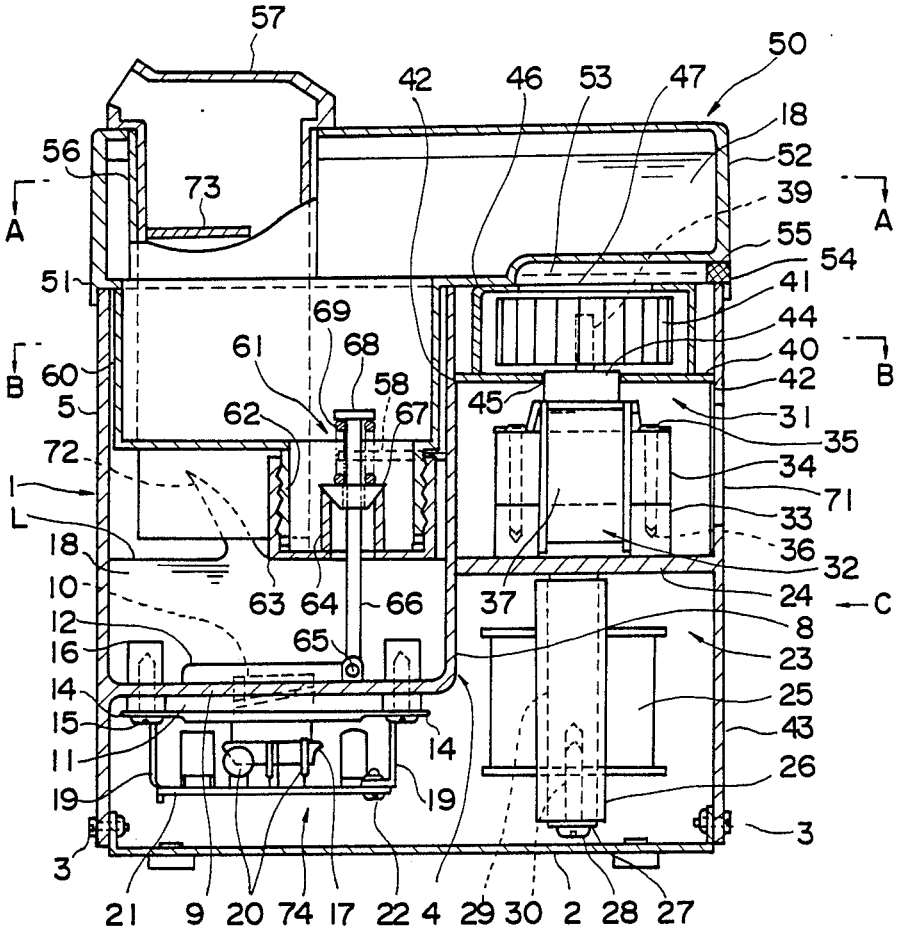
FIG. 1 is a front sectional view showing one embodiment of an atomizing apparatus according to the present invention.

FIGS. 1 through 4 show one embodiment according to the present invention. The apparatus body, indicated at 1, is rectangular in horizontal section, having open upper and lower surfaces. A bottom plate 2 mounted on the bottom surface by means of screws 3. An atomizing tank 4 is provided within the body 1. The tank or chamber 4 is not constructed separately from the body 1. In order to reduce the size of the body 1, the atomizing tank 4 uses one side plate 5 of the body 1 and part of front and rear plates 6 and 7 common to the body 1. The tank 4 is thus composed of the side plate 5 and front and rear plates 6 and 7. A partitioning plate 8 is longitudinally or vertically provided generally in the middle portion in the lateral direction of the body 1 and the tank 4 has a bottom plate 9.

An ultrasonic vibrator 10 is mounted on the bottom plate 9 of the atomizing chamber 4. In mounting the vibrator 10, an annular projecting portion 12 of a metal case 11 formed of aluminum or the like incorporating therein the vibrator 10 is fitted into a circular opening of the bottom plate 9 through a packing (not shown). Screws 15 are inserted into mounting projecting portions 14 at four corners of the base 11 and holes in the bottom plate 9. The screws 9 are screwed into internal threads 16 provided on the upper surface of the bottom plate 9. In this embodiment, in order to water-cool a power transistor 17 for driving the vibrator 10, the power transistor 17 is mounted on the lower surface of the metal base 11 in contact with water 18 within the atomizing chamber 4. The transistor 17 may be directly cooled by water within the atomizing chamber for miniaturization. In addition, in order to make the structure small including the driving circuit, an arm 19 is provided on the undersurface of the metal base 11. A substrate 21 is mounted on the arm 19 by means of a screw 22. Various elements 20 constituting a driving circuit on the substrate 21 are mounted in the periphery of the power transistor 17 so as to encircle the latter, whereby a mounting space for an atomizing unit 74 (which comprises a driving circuit including the vibrator 10, the driving element 20, the power transistor 17, etc.) is reduced.

A space 23 adjacent to the atomizing chamber 4 is partitioned by a lateral partitioning plate 24 provided generally at an intermediate level of the body 1. In a room below the partitioning plate 24 is provided a power transformer 25 which constitutes a power source portion or power transformer portion for supplying power to the atomizing unit 74. More specifically, the power transformer 25 is mounted by inserting screws 28 into projecting pieces 27 on both sides at the lower end of a mounting frame 26 of the power transformer 25. The screws 28 are screwed into tapped holes 30 which are provided from below in longitudinally (or vertically) formed projections 29 in the inner walls of the front and rear plates 6 and 7 of the body 1.

Figure 3:
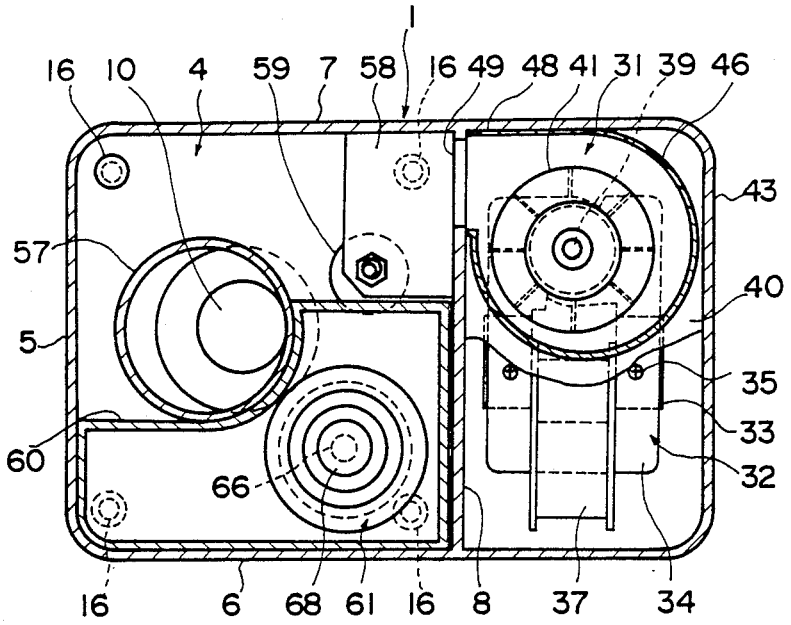
FIG. 3 is a sectional view taken on line B—B of FIG. 1.
Figure 4:
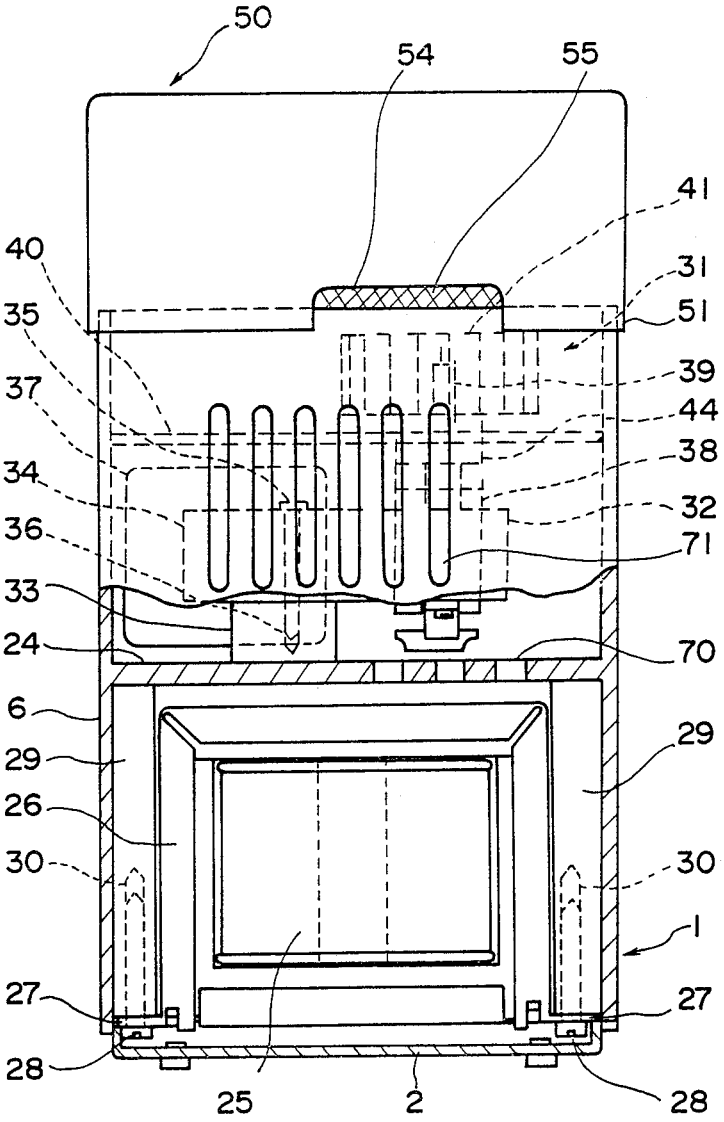
FIG. 4 is a view taken at C of FIG. 1.

On the lateral partitioning plate 24 is provided an electric fan 31 for blowing air to the atomizing tank 4 as shown in FIGS. 1, 3 and 4. That is, on the partitioning plate 24 is formed a base 33 for fixing a driving motor 32 (34 denotes a yoke, 37 a winding wound around the yoke 34, 38 a rotor and 39 an output shaft). The yoke 34 of the motor 32 is placed on the base 33, and mounting screws 35 are inserted into holes formed in the yoke 34 and screwed into tapped holes 36 formed in the base 33 to thereby mount the motor 32. The lateral partitioning plate 24 is formed with a ventilating and wiring hole 70, and a side plate 43 of the body 1 is also formed with a vent hole 71. A fan 41, radially provided with blades is mounted on the output shaft 39 so that when the fan is rotated in a horizontal plan, air is blown in a horizontal direction. A lateral partitioning plate 40, which also serves as a lower case for the fan 41, is placed on the inner wall of the side plate 43 of the body 1 and on an offset portion 42 formed in the vertically partitioning plate 8 and secured by means such as adhesives. An upper bearing 44 of a rotor 38 is fit into a center hole 45 of the lateral partitioning plate 40. Reference numeral 46 designates a circular upper case secured to the lateral partitioning plate 40. The upper case 46 has an intake opening 47 in the center thereof, and as shown in FIG. 3. A discharge opening 48, provided in the upper case 46, is brought into communication with an opening 49 provided in the vertically partitioning plate 8. In this way, the fan 41 is laterally directed because the overall height of the electric fan 31 including the motor 32 is reduced to make the size of the body 1 small.

A water tank 50, which is filled with water 18, has a fitting edge 51 so as to be fitted in the upper edge of the body 1. When the fitting edge 51 is fitted in the body 1, the water tank 50 also serves as a cover of the atomizing chamber 4 to prevent atomized water from flowing from the atomizing tank 4 to the outside.

Figure 2:
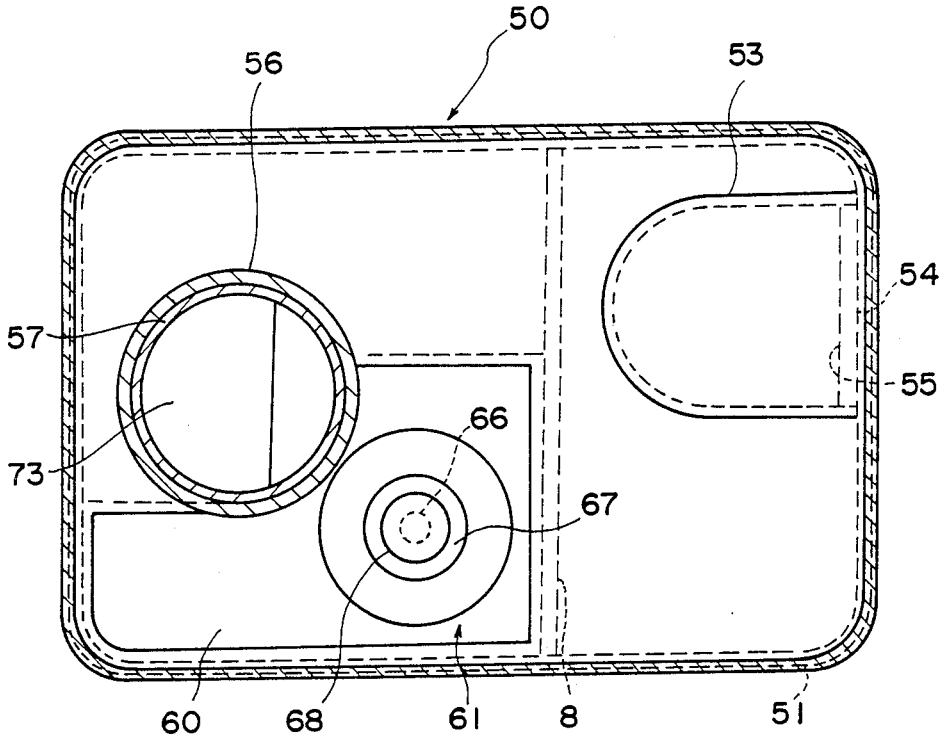
FIG. 2 is a sectional view taken on line A—A of FIG. 1.

As shown in FIGS. 1 and 2, a portion from a part of the bottom of the water tank 50, i.e., one side 52 of the water tank 50 to a portion facing to the upper portion of the fan 41 is formed into an upwardly depressed shape so that the recess portion 53 serves as an air intake passage. An intake opening 54 is formed between the upper edge of the side plate 43 of the body 1 and the recess portion 53. The intake opening 54 has a filter 55 mounted thereon. Since the opening 54 is provided at a high level, when the apparatus is put on the floor surface, suction of dusts can be minimized, and even if various articles are placed on the floor surface, suction of air can be secured to minimize limitations in installation. Moreover, since the electric fan 31 is installed above the power transformer portion 25, the fan 41 is positioned above the motor 32 and the intake opening 54 is provided between the body 1 and the water tank 50, so that the length of a flowpassage from the opening 54 to the atomizing tank 4 caused by the fan 31 is reduced. Moreover, since the power transistor 17 is cooled by water, cooling by air through the electric fan 31 is not necessary, thus decreasing the capacity of the electric fan 31 to contribute to miniaturization.

A cylindrical member 56 having upper and lower ends secured to upper and bottom plates of the water tank 50 is provided on a portion of the water tank 50 corresponding to the upper portion of the vibrator 10. A mist discharge pipe or exhaust duct 57 is fitted in the cylindrical member 56. The lower end of the exhaust duct 57 is set at a level slightly higher than a water level L within the atomizing chamber 4 which is determined by an automatic water valve 61 which will be described later.

As shown in FIG. 3, secured to one corner of the atomizing chamber 4 is a horizontal plate 58, on which is mounted a water level detector device 59 which automatically stops the operation of the vibrator 10 due to a low water level actuated by a heat loss preventive float switch or the like. A part of the bottom surface of the water chamber 50 corresponding to the atomizing tank 4 is projected (60) so as to occupy areas other than a portion in the space within the atomizing chamber 4 where the switch 59 is provided. One portion is occupied by the exhaust duct 57 and another portion or area is occupied by the water 18. An automatic water valve 60 is mounted on the bottom surface of the projecting portion 60 whereby water 18 is filled through the portion of the projecting portion 60 to enlarge the areas.

The automatic water valve 61 is composed, as shown in FIGS. 1 and 2, by an external thread tube 62 which projects to the lower surface of the projecting portion 60. An internal thread tube 63 is screwed into the external thread tube 62. A tubular valve seat 64 is provided coaxial with the internal thread tube 63. A rod 66 is inserted into the valve seat 64 and has a lower end connected to the bottom surface of the atomizing chamber 4 by means of a pin 65. A valve body 67 is fitted movably up and down to the rod 66. A bias spring 69, which is wound around the rod 66, is provided between the valve body 67 and a spring shackle 68 on the upper end of the rod 66. When the water level L within the atomizing tank 4 is below the bottom surface of the internal thread tube 63, air forcibly opens a passage between the valve seat 64 and the valve body 67 and passes therethrough an equal amount of water. The water enters the water tank 50 and flows from the water chamber 50 down into the atomizing tank 4, which is a well known mechanism.

In this atomizing apparatus, the vibrator 10 is vibrated to thereby form a water column 72 within the exhaust duct 57. Mists generated around the water column 72 are taken on an air stream ascending within the exhaust pipe 57 by the electric fan 31 and exhausted outside from an exhausting flowpassage defined by a straightening plate 73. It is noted that the vibrator 10 is inclined because the water column 72 is formed obliquely to thereby prevent the once generated mists from falling into the water column, to increase the atomizing efficiency.

Next, an embodiment of an ultrasonic atomizing unit used for the aforementioned apparatus will be described with reference to the drawings.

Figure 5:
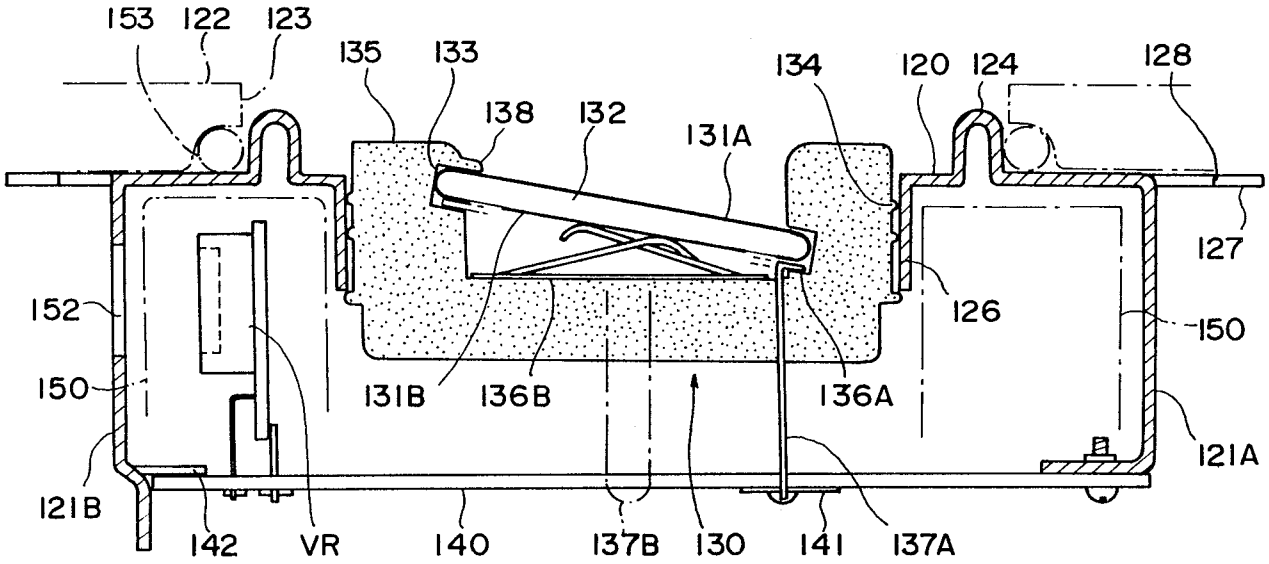
FIG. 5 is an enlarged front sectional view showing an embodiment of an ultrasonic atomizing unit according to the present invention.
Figure 6:
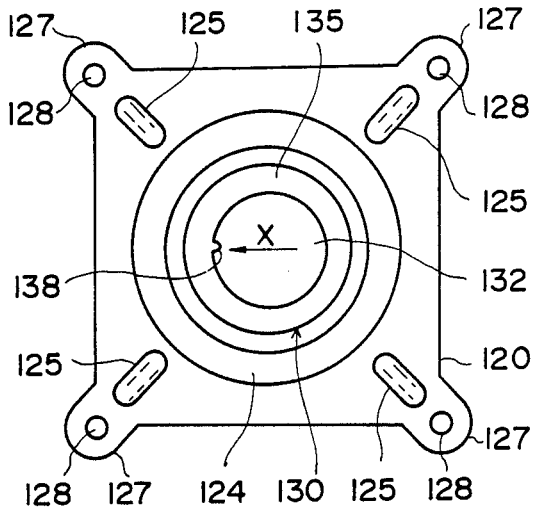
FIG. 6 is a plan view thereof.
Figure 7:
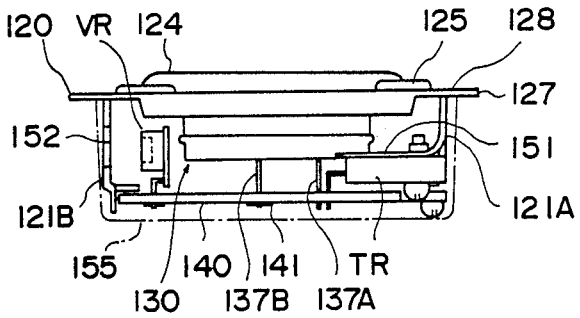
FIG. 7 is a front view of the same.

Referring to FIGS. 5 to 7, a metal base 120, which corresponds to metal base 1 in FIG. 1, is formed from an aluminum sheet or the like having a thickness of approximately 0.8 to 1 mm. The metal base 120 has side portions 121A and 121B bended vertically on opposite sides. In the central portion on the upper surface of the base 120 annular ribs 124 are simultaneously formed by a press and are fitted into a mounting hole 123 of a water tank bottom 122 of a moistening device. A radial rib 125 extends externally thereof. Mounting portions 127 are located at four corners. A mounting hole 128 (which is used to secure the base 120 to the ultrasonic moistening device) and a vibrator mounting hole 126, internally of the annular rib 124 are also on the base.

A vibrator supporting construction 130 is composed of a disc-like piezo-electric vibrator 132 having an electrode 131A on the radiation surface side on an ultrasonic radiation surface of disc-like piezo-electric ceramic and an opposed electrode 131B on the surface opposed thereto. A closed-end tubular resilient resin member 135 is formed with an inner-peripherally inclined annular groove 133 and is formed with a plurality of annular convexed portions 134 in the outer peripheral surface thereof. A first electrode 136A is in contact with a turned electrode portion of the electrode 131A on the radiation surface side. A second electrode 136B is in resilient contact with the opposed electrode 131B. The second electrode 136B in contact with the opposed electrode 131B of the piezo-electric vibrator 132 is arranged within the resilient resin member 135. A lead 137B of the second electrode 136B is drawn out of the bottom of the resilient resin member 135. The first electrode 136A in contact with the turned portion of the electrode 131A of the piezo-electric vibrator 132 is superposed onto the piezo-electric vibrator 132. Both elements are water-tightly fitted into the inner-peripherally inclined annular groove 133 of the resilient resin member 135. A lead 137A of the first electrode 136A is drawn out of the bottom of the resilient resin member 135.

An identifying convex portion 138 is formed in the inner periphery of the resilient resin member 135 in order to indicate the inclining direction (in the direction as indicated by arrow X) of the piezo-electric vibrator 132.

The vibrator supporting construction 130 as described above is water-tightly fitted in the inner periphery of the vibrator mounting hole 126 of the metal base 120 so that the inclining direction of the piezo-electric vibrator 132 is directed in a specific direction.

The metal base 120 has generally a square in plan as shown in FIG. 6 and is in the shape to be geometrically point-symmetry with respect to the center of the piezo-electric vibrator 132. The mounting holes 128 formed in the mounting portions 127 at the four corners of the base 120 are arranged to assume the position to be geometrically point-symmetry with respect to the center of the piezo-electric vibrator 132. Each of the mounting holes 128 can be a through-hole or can be a threaded hole as necessary.

Figure 8:
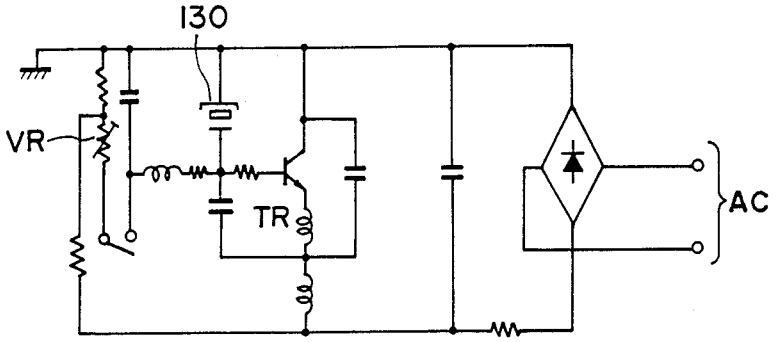
FIG. 8(*a*) is a circuitry representation showing one example of a driving circuit used in the embodiment.
Figure 8:
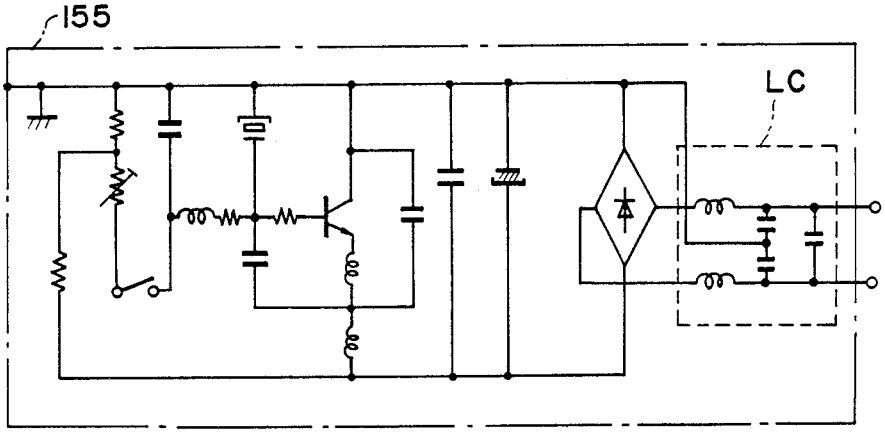
Figure 9:
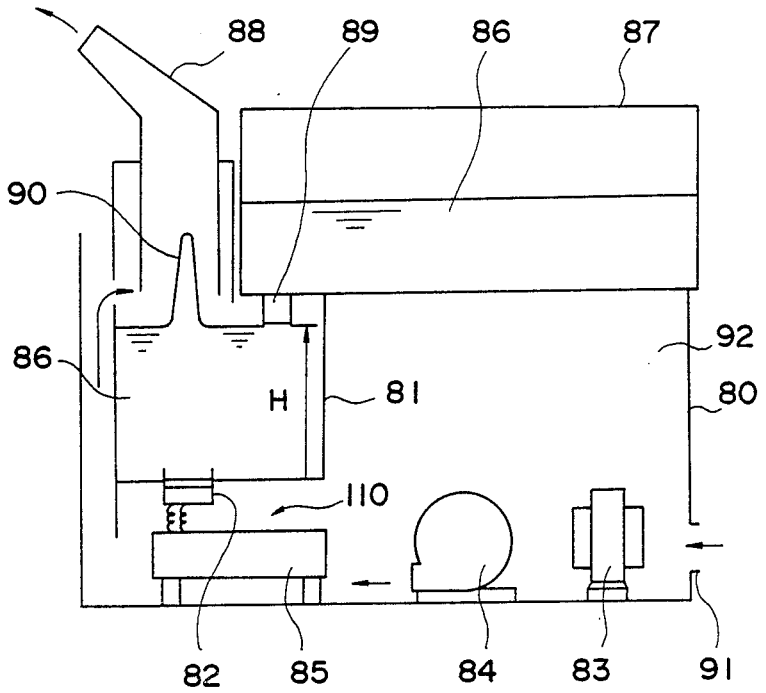
FIG. 9 is a schematic sectional view of a conventional apparatus.
Figure 10:
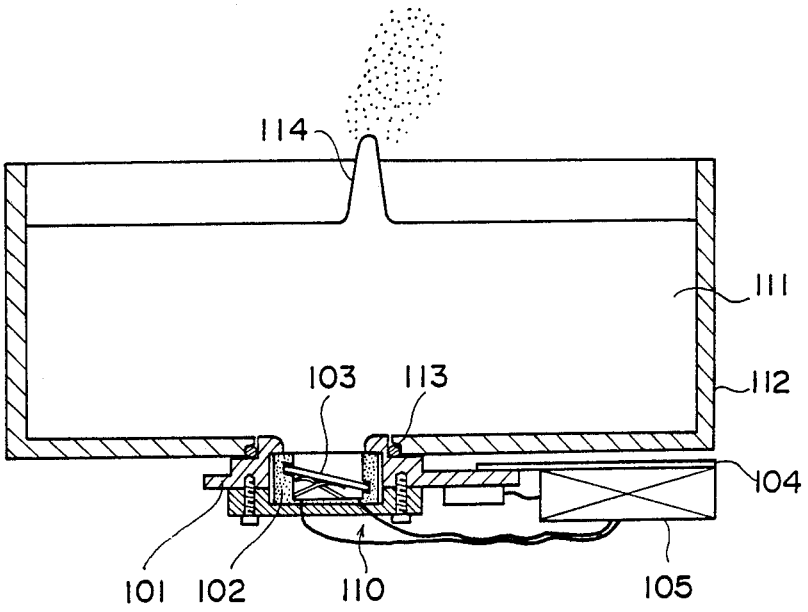
FIG. 10 is a front sectional view showing one example of an ultrasonic moistening device having a conventional ultrasonic atomizing unit mounted thereon.
Figure 11:
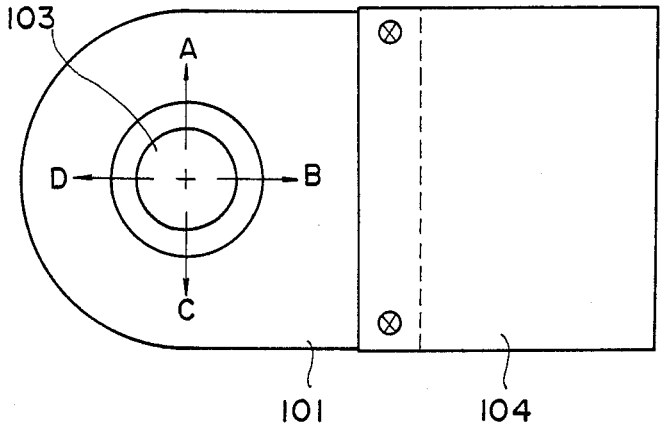
FIG. 11 is a plan view showing a conventional ultrasonic atomizing unit.

A driving circuit for oscillating the piezo-electric vibrator 132 is a collector-grounded type Colpitts self-oscillation circuit, for example, as shown in FIG. 8(*a*). The driving circuit is assembled on the print substrate 140. This print substrate 140 is arranged parallel to a plane portion of the metal base 120. Leads 137A and 137B of the electrodes 136A and 136B which are pressed against the piezo-electric vibrator 132 are directly connected to a conductive pattern 141 on the reverse side of the substrate. Also, the print substrate 140 is secured to one side portion 121A by means of screws, and is positioned and supported by a lug 142 of the other side portion 121B.

In the space around the vibrator supporting construction 130 on the print substrate 140 are arranged components 150 for the driving circuit, for example, such as a transistor TR, an output regulating semi-fixed variable resistor VR, etc. The transistor TR is closely secured by means of a screw to a bended portion 151 formed by partly bending the side portion of the metal base 120 inwardly for the purpose of heat radiation. The side portion 121B is formed with a through-hole 152 so that the semi-fixed variable resistor VR may be regulated from outside.

The ultrasonic atomizing unit is described above is mounted on the side of the moistening device by water-tightly mounting the metal base 120 in the mounting hole 123 in the water tank bottom 122 of the moistening device storing liquids to be atomized, through an O-ring 153.

As shown by the broken lines in FIG. 7, a shield member 155 is arranged so as to cover the reverse side of the print substrate in order to relieve radiation noises and is mounted on the base 120 with conductivity.

In this case, the shield case can be of iron or Bs sheet having a thickness of 0.3 to 0.5 mm. A filter in the form of LC (a circuit consisting of an induction coil L and a capacitor C) may be incorporated into a power line as shown in FIG. 8(*b*) for relieving the line noise to thereby relieve the noises in a compact and positive manner.

As described above, according to the first invention, a power source portion for supplying power to an atomizing unit and an electric fan for blowing air to an atomizing tank are laterally arranged in a space adjacent the atomizing tank provided within the body. Therefore, the space within the body is effectively utilized to realize miniaturization. Thus, even when a small-capacity moistening device is placed in a narrow room, less space is occupied. In addition, by miniaturization of the device, inexpensive moistening devices may be provided.

Furthermore, according to the second invention, a bottom portion of a water tank, placed on the body corresponding to an atomizing tank, is projected downwardly so as to occupy an area other than areas occupied by a exhaust pipe for mists to be discharged outside. A heat loss preventive water-level detector is located within the atomizing tank. The projection has an automatic water valve mounted on the bottom thereof. Therefore, the space within the atomizing tank may be effectively utilized to thereby achieve a miniaturization of the entire apparatus. Thus, even when a small-capacity moistening device is placed in a narrow room, less space is occupied. In addition, by miniaturization, inexpensive moistening devices may be provided.

Moreover, according to the construction of the ultrasonic atomizing unit which has been described as the third invention, the following effects may be obtained:

(1) Since the mounting hole 128 of the metal base 120 is of the point-symmetry with respect to the center of the piezo-electric vibrator 132 geometrically, the mounting position of the unit may be suitably set with respect to the ultrasonic moistening device body by rotation thereof. Therefore, even if the vibrating surface of the vibrator is inclined, the inclining direction may be selected to the optimum direction according to various ultrasonic moistening devices. With this, in the production process, assembling may be carried out by defining all the inclining directions of the vibrator in a fixed direction, thus enabling an improvement in volume productivity to enhance the working efficiency.

(2) The lead of the electrode pressed against the piezo-electric vibrator 132 is directly connected to the conductive pattern of the print substrate 140 whereby the print substrate may be arranged in the proximity of the bottom of the vibrator supporting construction 130 to reduce the thickness of the configuration.

(3) The components of the driving circuit may be arranged in the space around the piezo-electric vibrator on the print substrate (the space around the vibrator supporting construction) to package parts with high density to realize a miniaturization of the construction.

(4) The metal base 120 is formed from a thin sheet such as aluminum, and ribs for increasing the rigidity of the metal base such as an annular rib 124 encircling the periphery of the piezo-electric vibrator, a radial rib 125 extending externally of the annular rib, etc. may be formed by a press or the like to thereby manufacture the products at lower cost than that of a base which is a thick die casting product.

(5) The base is placed in conductive relationship with the metal base 120 by a thin metal sheet so as to be entirely covered. Filters are incorporated into an oscillator and a print substrate to relieve the noises to thereby relieve the radiation noises and line noises.

What is claimed is:

1. An ultrasonic atomizing apparatus comprising:

a main body having the shape of a bottomed box;

a water tank provided on top of said main body in an upper opening of the same;

a partition wall partitioning an interior of said main body under said water tank into first and second sections;

an atomizing chamber formed in an upper portion of said first section to receive water from said water tank;

an atomizing unit provided on a bottom wall of said atomizing chamber to atomize the water supplied into said atomizing chamber, and including a piezoelectric oscillator and a piezoelectric oscillator driving circuit;

an electric fan provided within said second section of said main body to blow the mist produced in said atomizing chamber;

a power transformer disposed within said second section of said main body in a vertical positional relationship to said electric fan to supply power to said electric fan and the driving circuit of said atomizing unit; and an exhaust duct communicating with the upper portion of said atomizing chamber, and arranged so as to discharge upward the mist blow by said electric fan.

2. An ultrasonic atomizing apparatus as recited in claim 1, wherein a bottom wall of said water tank is protruded downward to form a protrusive portion protruding into said atomizing chamber in the first section of said main body, and said electric fan and said power transformer are disposed under said water tank in the second section of said main body.

3. An atomizing apparatus as recited in claim 1 or 2, wherein said electric fan is disposed above said power transformer, and said electric fan comprises a vertical motor and an fan attached to an output shaft of said vertical motor so as to blow air in a horizontal direction.

4. An ultrasonic atomizing apparatus as recited in claim 1 or 2, wherein an air inlet opening is formed between said electric fan and a bottom wall of said water tank.

5. An ultrasonic atomizing apparatus as recited in claim 1, wherein at least part of the periphery of said water tank is fitted in an upper brim of said atomizing chamber so that said water tank serves also as a lid of said atomizing chamber.

6. An ultrasonic atomizing apparatus as recited in any one of claims 1, 2, or 5, wherein a receptacle is formed in part of said water tank, and said exhaust duct is fitted in said receptacle.

7. An ultrasonic atomizing apparatus as recited in any one of claims 1, 2, or 5, wherein said atomizing unit comprises a piezoelectric oscillator, a supporting structure supporting the piezoelectric oscillator, a metallic base fitted in the supporting structure in a watertight condition and attached to the bottom wall of said atomizing chamber, a power transistor mounted on the metallic base, and a printed wiring board mounted with circuit elements other than the power transistor.

8. An ultrasonic atomizing apparatus as recited in claim 7, wherein the piezoelectric oscillator of said atomizing unit is mounted on said metallic base, holes are formed in said metallic base in point symmetry with respect to a center of said piezoelectric oscillator, and electrodes of said piezoelectric oscillator are connected directly to a conductive pattern of the printed wiring board carrying driving circuits for driving said piezoelectric oscillator by lead lines.

9. An ultrasonic atomizing apparatus as recited in claim 7, wherein said metallic base is a thin metallic plate having an annular rib formed so as to surround said piezoelectric oscillator, and radial ribs extending radially outward from the annular rib.

10. An ultrasonic atomizing apparatus as recited in claim 7, wherein said printed wiring board and said driving circuits carried on said printed wiring board are covered with a shielding case, the shielding case is connected electrically to said metallic base, and a line filter including an inductance coil and a capacitor is mounted on said printed wiring board.

11. An ultrasonic atomizing apparatus as recited in claim 7, wherein said supporting structure is provided with a groove for receiving said piezoelectric oscillator therein to hold the same, said piezoelectric oscillator has a first electrode in a first major surface thereof, and a second electrode in a second major surface thereof, the second electrode is connected to a plate-shaped elastic electrode member provided in the groove of said supporting structure and extending outside the supporting structure through a bottom of the same, and the first electrode is connected directly to said printed wiring board through plate-shaped electrode member in contact with the first electrode and penetrating through the supporting structure.

* * * * *